US006833823B2

(12) United States Patent
Sakita

(10) Patent No.: US 6,833,823 B2
(45) Date of Patent: Dec. 21, 2004

(54) METHOD AND DEVICE FOR DRIVING AC TYPE PDP

(75) Inventor: Koichi Sakita, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 216 days.

(21) Appl. No.: 09/949,086

(22) Filed: Sep. 10, 2001

(65) Prior Publication Data

US 2002/0140639 A1 Oct. 3, 2002

(30) Foreign Application Priority Data

Mar. 30, 2001 (JP) ..... 2001-098321

(51) Int. Cl.[7] ..... G09G 3/28
(52) U.S. Cl. ..... 345/60; 345/66; 345/67
(58) Field of Search ..... 345/60, 63, 66–68; 315/169.4; 313/582–587

(56) References Cited

U.S. PATENT DOCUMENTS 5,519,520 A * 5/1996 Stoller ..... 349/32
5,943,030 A * 8/1999 Minamibayashi ..... 345/60

* cited by examiner

*Primary Examiner*—Jimmy H. Nguyen
(74) *Attorney, Agent, or Firm*—Staas & Halsey LLP

(57) ABSTRACT

A method for driving a PDP is provided in which addressing having little influence from operating environment changes is realized without increasing withstand voltage of circuit components, so that a display is stabilized. The method comprises the step of keeping a scan electrode in high impedance state to a power source line over a part or the entire period of a selection waiting period before the scan electrode is biased to a selection potential level.

10 Claims, 20 Drawing Sheets

METHOD AND DEVICE FOR DRIVING AC TYPE PDP

BACKGROUND OF THE INVENTION

1. Field of the Invention

The present invention relates to a method and device for driving an AC type PDP.

2. Description of the Prior Art

A PDP (Plasma Display Panel) is widely used for a television or a computer monitor after a color screen was commercialized. As being widespread, the use environment has become diversified, and a driving method is desired that can realize a stable display without affected by temperature variation or voltage fluctuation of a power source.

As a color display device, an AC type PDP utilizing a surface discharge format has been commercialized. The surface discharge format has a structure in which display electrodes (first electrodes and second electrodes) to be anodes and cathodes in display discharge for securing luminance are arranged in parallel on a front or back substrate, while address electrodes (third electrodes) are arranged so as to cross the display electrode pairs. The arrangement of the display electrodes includes a form in which a pair of display electrodes is arranged for each row of a matrix display and another form in which the first and the second display electrodes are arranged alternately at a constant distance. In the latter case, each display electrode except ones at both ends of the arrangement works for two rows of display. Regardless of the arrangement form, the display electrode pairs are covered with a dielectric layer.

In the surface discharge format PDP display, one of the display electrodes (the second electrode) corresponding to each row is used as a scan electrode for row selection, so that address discharge is generated between the scan electrode and the address electrode, and the discharge causes another address discharge between the display electrodes. Thus, addressing is performed in which charge quantity in the dielectric (wall charge quantity) is controlled in accordance with display contents. After the addressing, a sustaining voltage Vs having alternating polarities is applied to the display electrode pair. The sustaining voltage Vs satisfies the following inequality (1).

$$Vf_{XY}-Vw_{XY}<Vs<Vf_{XY} \quad (1)$$

$Vf_{XY}$: discharge start voltage between display electrodes.

$Vw_{XY}$: wall voltage between display electrodes.

When the sustaining voltage Vs is applied, cell voltage (the sum of the drive voltage applied to the electrode and the wall voltage) exceeds the discharge start voltage $Vf_{XY}$ only in cells having a predetermined quantity of wall charge so as to generate surface discharge on the substrate surface. As the application period is shortened, the light emission can be seen continuously.

A discharge cell of the PDP is basically a binary light emission element. Therefore, a halftone is reproduced by setting integral light emission quantity of each discharge cell in a frame period in accordance with a gradation value of input image data. A color display is one type of the gradation display, and a display color is determined by combining luminance values of three primary colors. The gradation display is performed by a method in which one frame includes plural subframes (subfields in an interlace display) having a weight of luminance, and the integral light emission quantity is determined by combining on and off of light emission of subframes. For example, 256-gradation display can be achieved by dividing a frame into eight subframes having luminance weights of 1, 2, 4, 8, 16, 32, 64 and 128. In general, weighting of luminance is set by the number of light emission times.

FIG. 18 shows voltage waveforms of a general driving sequence. In FIG. 18, reference letters X, Y and A indicate a first display electrode, a second display electrode and an address electrode, respectively. Indices 1–n of the reference letters X and Y indicate arrangement order of the row corresponding to the display electrodes X and Y. Indices 1–m of the reference letter A indicate arrangement order of the column corresponding to the address electrode A.

The subframe periods Tsf assigned to subframes are classified roughly into a reset period TR for equalizing charge distribution on the screen, an address period TA for forming charge distribution corresponding to display contents by applying a scan pulse Py and an address pulse Pa and a sustaining period TS for securing luminance corresponding to the gradation value by applying a sustaining pulse Ps. The reset period TR and the address period TA have constant lengths regardless of the luminance weight, while the sustaining period TS has a variable length, which is longer as the luminance weight is larger. The illustrated waveform is an example. The amplitude, the polarity and the timing can be modified variously. The equalization of the charge distribution in the reset period TR can be achieved preferably by a method of controlling the charge quantity by applying a ramp waveform pulse.

FIG. 19 shows conventional driving voltage waveforms in the address period.

In the address period TA, an individual potential control is performed for each display electrode Y that is used as a scan electrode for row selection of an n×m screen. After biasing all the display electrodes Y to a non-selection potential Vya2 at the start point of the address period TA, the display electrode Y corresponding to the selected row i ($1 \leqq i \leqq n$) is temporarily biased to a selection potential Vya1 (application of the scan pulse). The illustrated row selection order is the same as the arrangement order of the row. In synchronization with the row selection, the address electrodes A in the column of the selected cell that generates the address discharge in the selected row is biased to the selection potential Vaa (application of the address pulse). The address electrodes A in the column of the non-selected cell are set to the ground potential (usually zero volt). The display electrodes X are biased to a constant potential Vxa from the start to the end of the addressing regardless of the selected row or the non-selected row.

In a PDP, inner charge characteristics depend on operating temperature, so that different display patterns generate different charged states between cells. Therefore, it was a problem in the conventional driving method that an addressing error can occur easily due to excessive or insufficient charge at interelectrode AY of the address electrode A and the display electrode Y. This problem will be explained below. FIG. 20 shows conventional waveforms of the cell voltage change in the address period. The thick solid line in FIG. 20 indicates an appropriate change of the cell voltage (the sum of the applied voltage and the wall voltage), while the chain line indicates an inappropriate change of the cell voltage.

Here, cells in the k-th column and in the j-th row of the selection order are noted. It is supposed that the address electrode A corresponding to the k-th column is biased to an address potential Vaa before the noted row becomes the selected row and in the period while the selected row is the (1–i)th (i<j) row. In other words, a display pattern is supposed in which display data $D_{1,k}$–$D_{i,k}$ of the first row through the i-th row in the k-th column are the selected data. The wall voltage at the interelectrode XY at the start point in the address period TA is denoted by Vwxy1, and the wall voltage at the interelectrode AY is denoted by Vway1.

If the operating temperature is appropriate, the wall voltage remains approximate initial value at the stage before the noted row becomes a selected row. Therefore, when the noted row becomes the selected row so that the display electrode $Y_j$ is biased to the selection potential Vya1 and the address electrode $A_k$ is biased to the address potential Vaa, the cell voltage at the interelectrode AY (Vway1+Vaa−Vya1) exceeds the discharge threshold level $Vf_{AY}$ so as to generate the address discharge. The address discharge causes the wall voltage change both at the interelectrode AY and the interelectrode XY, so that the charged state suitable for the operation of the following sustaining period is formed. The address discharge generates the wall voltage Vwxy2 at the interelectrode XY and the wall voltage Vway2 at the interelectrode AY.

Before the noted row becomes the selected row, even if the address electrode $A_k$ is biased to the address potential Vaa, discharge cannot occur since the cell voltage at the interelectrode AY of the noted row is lower than the discharge start threshold level $Vf_{AY}$. However, as the cell temperature becomes higher than the normal temperature along with increase of the ambient temperature or accumulation of display heat, the cell voltage at the interelectrode AY approaches the discharge start threshold level $Vf_{AY}$. Therefore, even if the cell voltage is below the discharge start threshold level $Vf_{AY}$, microdischarge may be generated, so that the wall voltage at the interelectrode AY changes. Remaining small amount of space charge can make the wall voltage change. This change of the wall voltage causes drop of the cell voltage at the interelectrode AY below the normal value when the noted row becomes the selected row, so that the address discharge intensity (quantity of the wall voltage change due to the discharge) decreases. Therefore, quantity of the wall voltage change at the interelectrode XY that should occur at the same time as the wall voltage change at the interelectrode AY in the address discharge also decreases. In this case, since the wall voltage at the interelectrode XY (Vwxy2') of the cell to be lighted is insufficient, a lighting error that will occur in the successive sustaining period may cause display distortion.

In order to suppress the undesired wall voltage change, it is preferable to decrease the difference between the non-selection potential Vya2 of the display electrode Y and the address potential Vaa of the address electrode A. However, in order to secure the intensity of the address discharge at the interelectrode AY, the difference between the selection potential Vya1 and the address potential Vaa should be sufficiently large. Therefore, decreasing the difference between the non-selection potential Vya2 and the address potential Vaa so that the address potential approaches the non-selection potential can spell enlarging the difference between the selection potential Vya1 and the non-selection potential Vya2 of the display electrode Y, resulting in an increase of withstand voltage of scan circuit components. In the address period, the voltage corresponding to the difference between the selection potential Vya1 and the non-selection potential Vya2 is applied across power source terminals of an integrated circuit component called a scan driver. The scan driver has to endure the voltage. Enhancement of the withstand voltage of the integrated circuit causes a substantial increase of component costs.

SUMMARY OF THE INVENTION

An object of the present invention is to realize addressing having little influence from operating environment changes without increasing withstand voltage of circuit components, so as to stabilize a display.

According to the present invention, in the address period for performing addressing, an electric path from scan electrodes to a power source is made in high impedance state during at least a part of a selection waiting period before the scan electrode is biased to a selection potential level. Thus, a current supply from the power source to cells via the scan electrodes can be substantially shut off, so that a wall charge change can be suppressed. Namely, appropriate address discharge can be generated without decreasing the difference between the non-selection potential Vya2 and the address potential Vaa and making the non-selection potential close to the address potential.

DESCRIPTION OF THE PREFERRED EMBODIMENTS

Hereinafter, the present invention will be explained more in detail with reference to embodiments and drawings.

Figure 1:
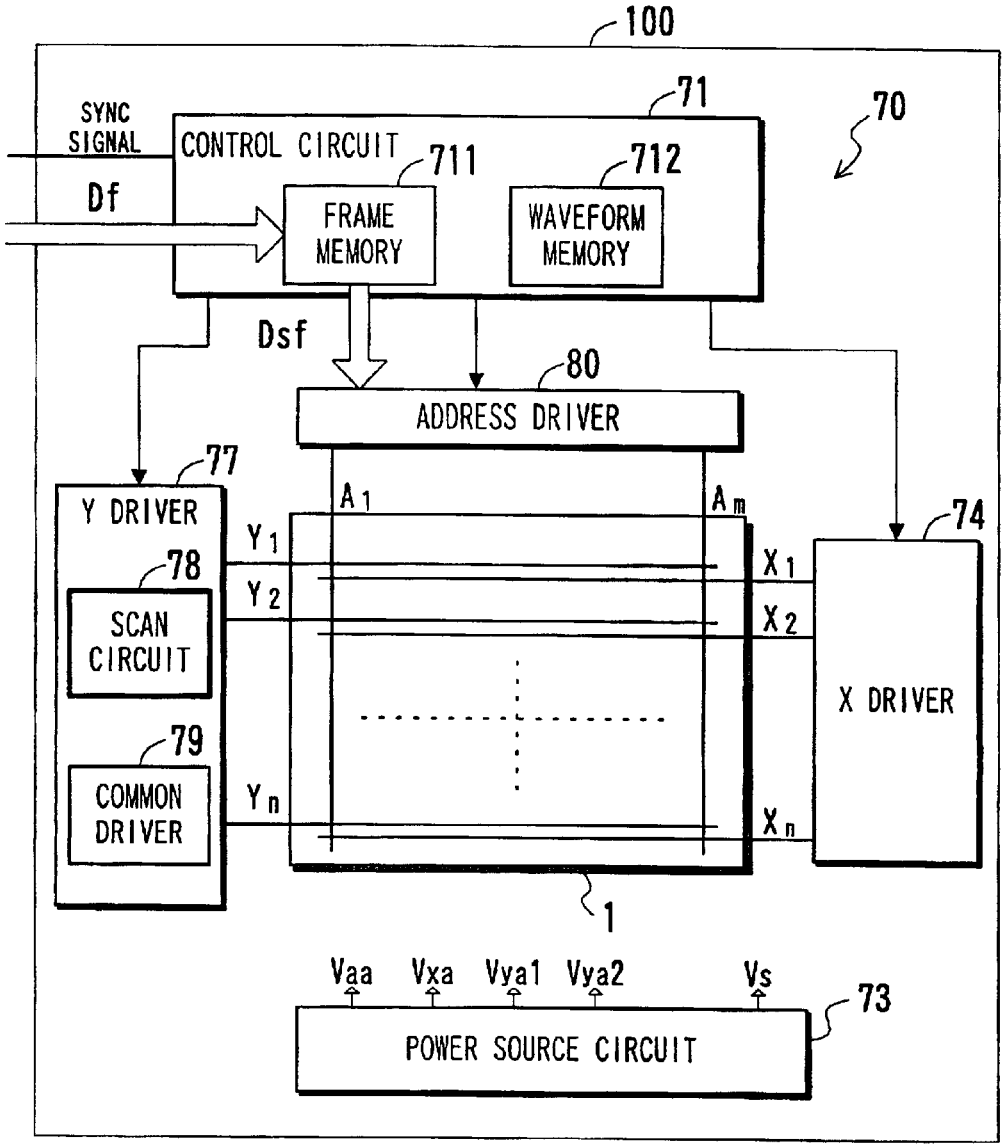
FIG. 1 is a block diagram of a display device according to the present invention.

FIG. 1 is a block diagram of a display device according to the present invention. The display device 100 comprises a surface discharge type PDP 1 having a screen of m columns and n rows and a drive unit 70 for controlling selective light emission of discharge cells arranged in a matrix. The display device 100 is used as a wall-hung television set or a monitor of a computer system.

The PDP 1 includes display electrodes X and Y arranged in parallel for generating display discharge and address electrodes A arranged so as to cross the display electrodes X and Y. The display electrodes X and Y extend in the row direction (horizontal direction) of the screen, and the display electrodes Y are used as scan electrodes for row selection in addressing. The address electrodes A extend in the column direction (vertical direction), and are used as data electrodes for column selection.

The drive unit 70 includes a control circuit 71 working for drive control, a power source circuit 73, an X driver 74, a Y driver 77 and an address driver 80. The drive unit 70 is supplied with frame data Df that are multivalued image data indicating luminance levels of red, green and blue colors along with various synchronizing signals from external equipment such as a TV tuner or a computer. The control circuit 71 includes a frame memory 711 for memorizing the frame data Df temporarily and a waveform memory 712 for memorizing control data of driving voltage.

The frame data Df are temporarily stored in the frame memory 711 and then are converted into subfield data Dsf for gradation display. Then, the data Dsf are transferred to the address driver 80. The subfield data Dsf are q-bit display data indicating q subfields (i.e., a set of display data for q screens, having one bit per subpixel). The subfield is a binary image having resolution of m×n. The value of each bit of the subfield data Dsf indicates on or off of light emission for the subpixel in the corresponding subfield, more specifically whether address discharge is necessary or not.

The X driver 74 controls potentials of n display electrodes X as a unit. The Y driver 77 includes a scan circuit 78 and a common driver 79. The scan circuit 78 is potential switching means for row selection in addressing. The address driver 80 controls potentials of total m address electrodes A in accordance with the subfield data Dsf. These drivers are supplied with predetermined power from the power source circuit 73 via a wiring conductor (not shown).

Figure 2:
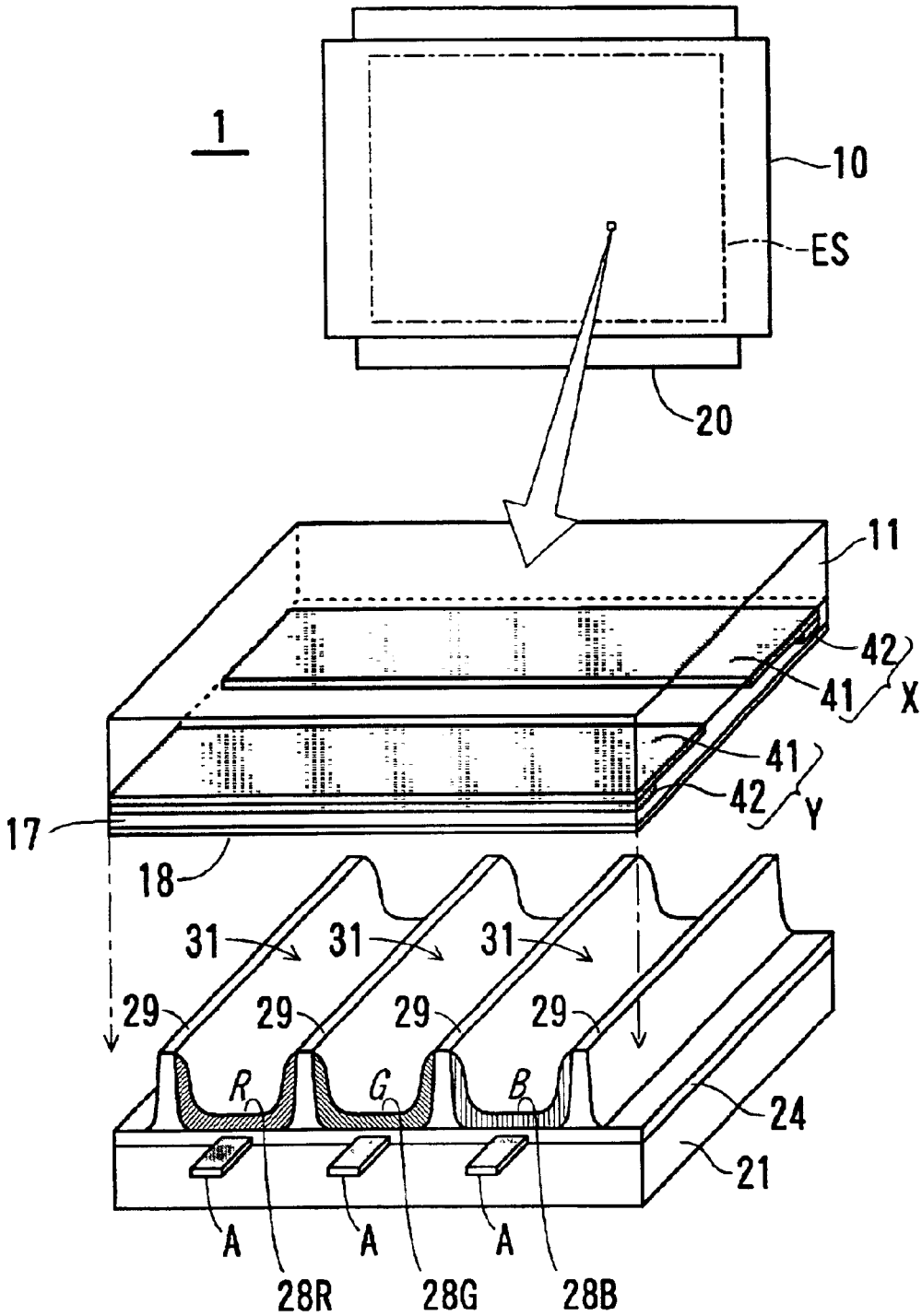
FIG. 2 shows a cell structure of a PDP according to the present invention.

FIG. 2 shows a cell structure of a PDP according to the present invention. The PDP 1 includes a pair of substrate structure (each structure includes a substrate on which discharge cell elements are arranged) 10 and 20. The discharge cells constitute a display screen ES, and display electrode pairs (including display electrodes X and Y) and address electrodes A cross each other in each of the discharge cells. The display electrodes X and Y are arranged on the inner surface of the front glass substrate 11, and each of them includes a transparent conductive film 41 forming a surface discharge gap and a metal film (a bus electrode) 42 extending over the entire length of the row. The display electrode pairs are covered with a dielectric layer 17 having thickness of approximately 30–50 μm. The dielectric layer 17 is coated with a protection film 18 made of magnesia (MgO). The address electrodes A are arranged on the inner surface of the back glass substrate 21 and are covered with a dielectric layer 24. On the dielectric layer 24, bandlike partitions 29 having heights of approximately 150 μm are arranged so that one partition 29 is positioned between the address electrodes A. The partitions 29 divide a discharge space in the row direction into columns. A column space 31 of the discharge space corresponding to a column is continuous over all rows. The inner surface of the backside including the upper face of the address electrode A and the side face of the partition 29 is covered with fluorescent material layers 28R, 28G and 28B of red, green and blue colors for a color display. Italic letters R, G and B in FIG. 2 denote light emission colors of the fluorescent material layers. The fluorescent material layers 28R, 28G and 28B are excited locally by ultraviolet rays emitted from a discharge gas, so as to emit light.

Figure 18:
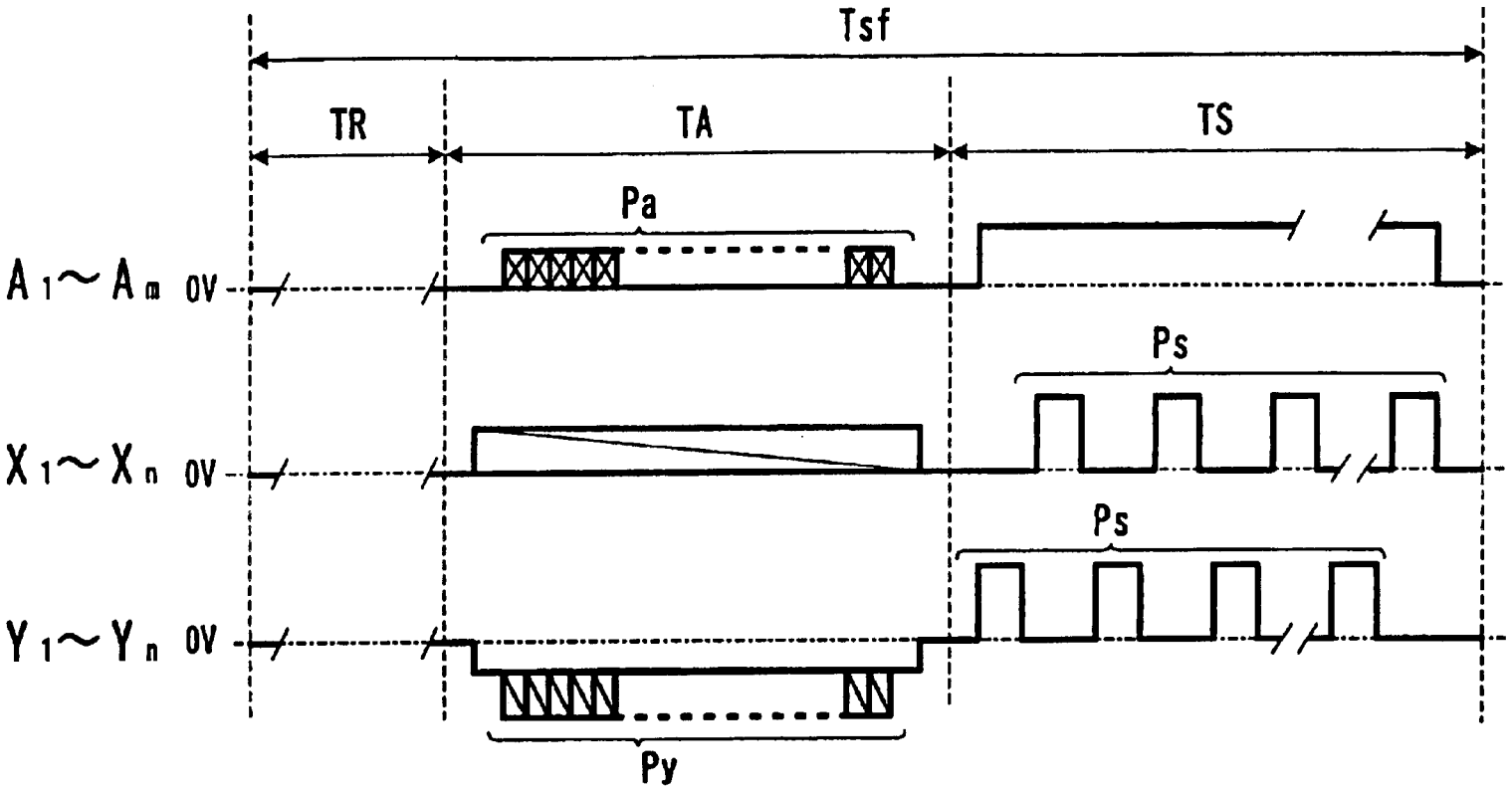
Fig. 18 (PRIOR ART)
FIG. 18 shows voltage waveforms of a general driving sequence.
Figure 19:
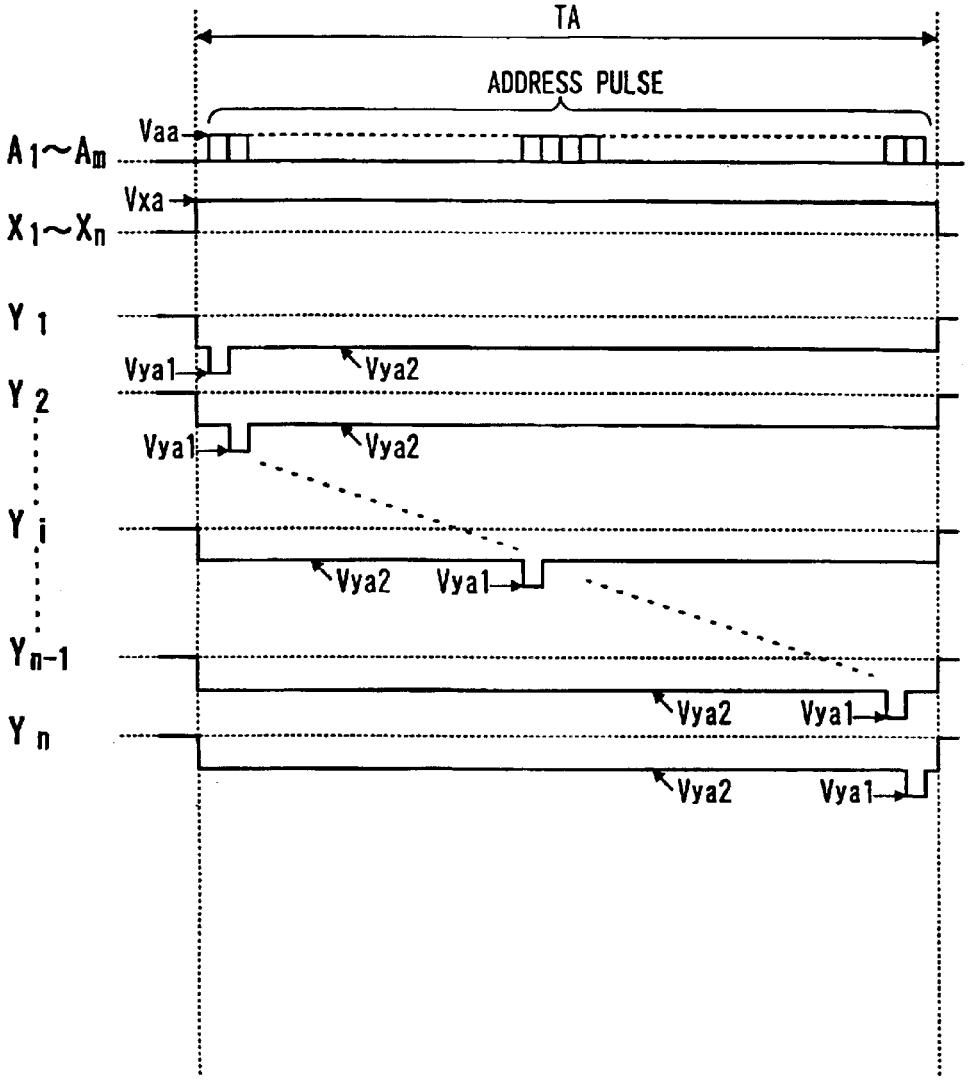
Fig. 19 (PRIOR ART)
FIG. 19 shows conventional driving voltage waveforms in the address period.

In a display, a period of one subfield is divided roughly into the reset period TR, the address period TA and the sustaining period TS as explained above (see FIG. 18). Hereinafter, a driving form in the address period TA according to the present invention will be explained.

Figure 3:
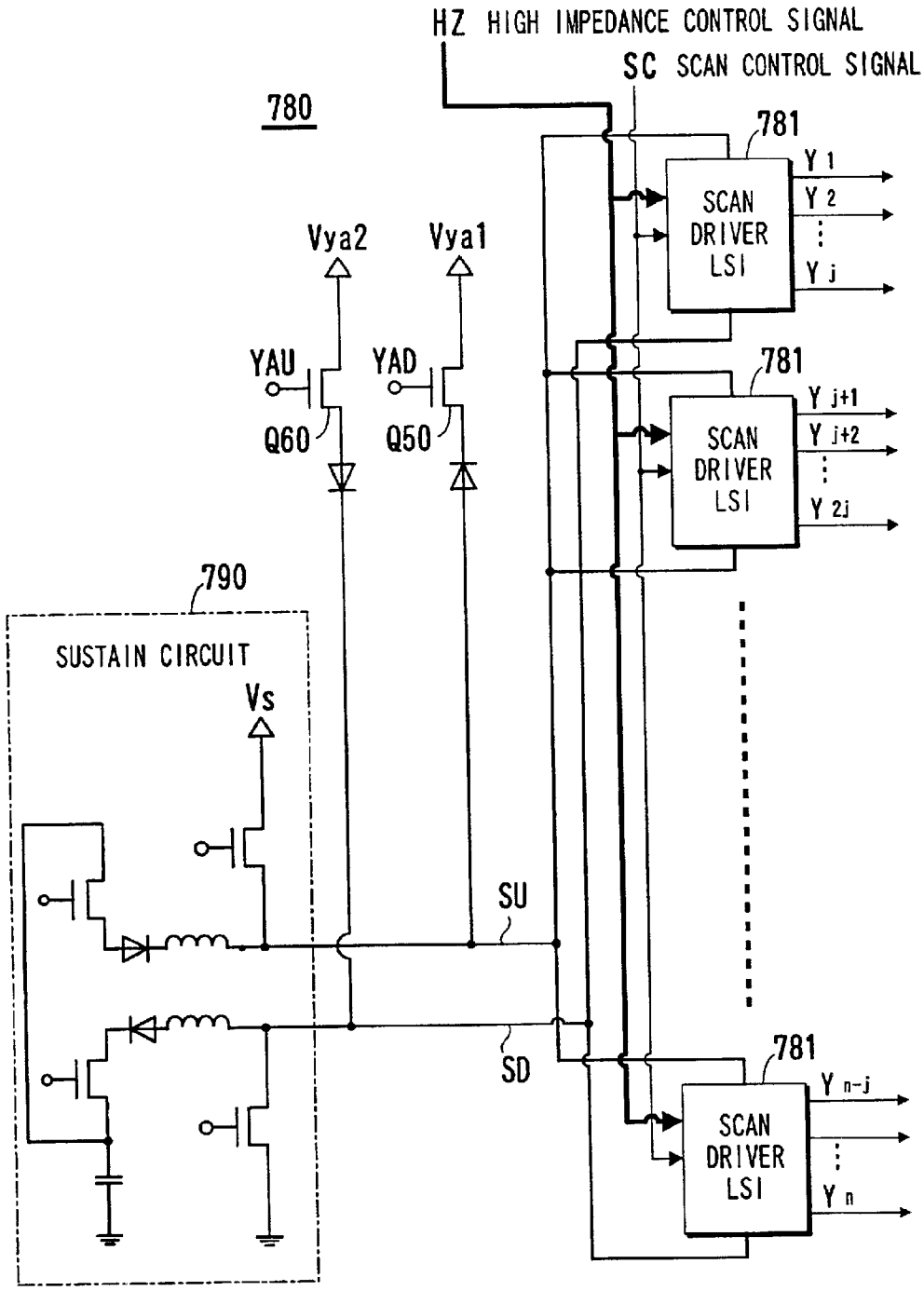
FIG. 3 is a diagram of a scan circuit.
Figure 4:
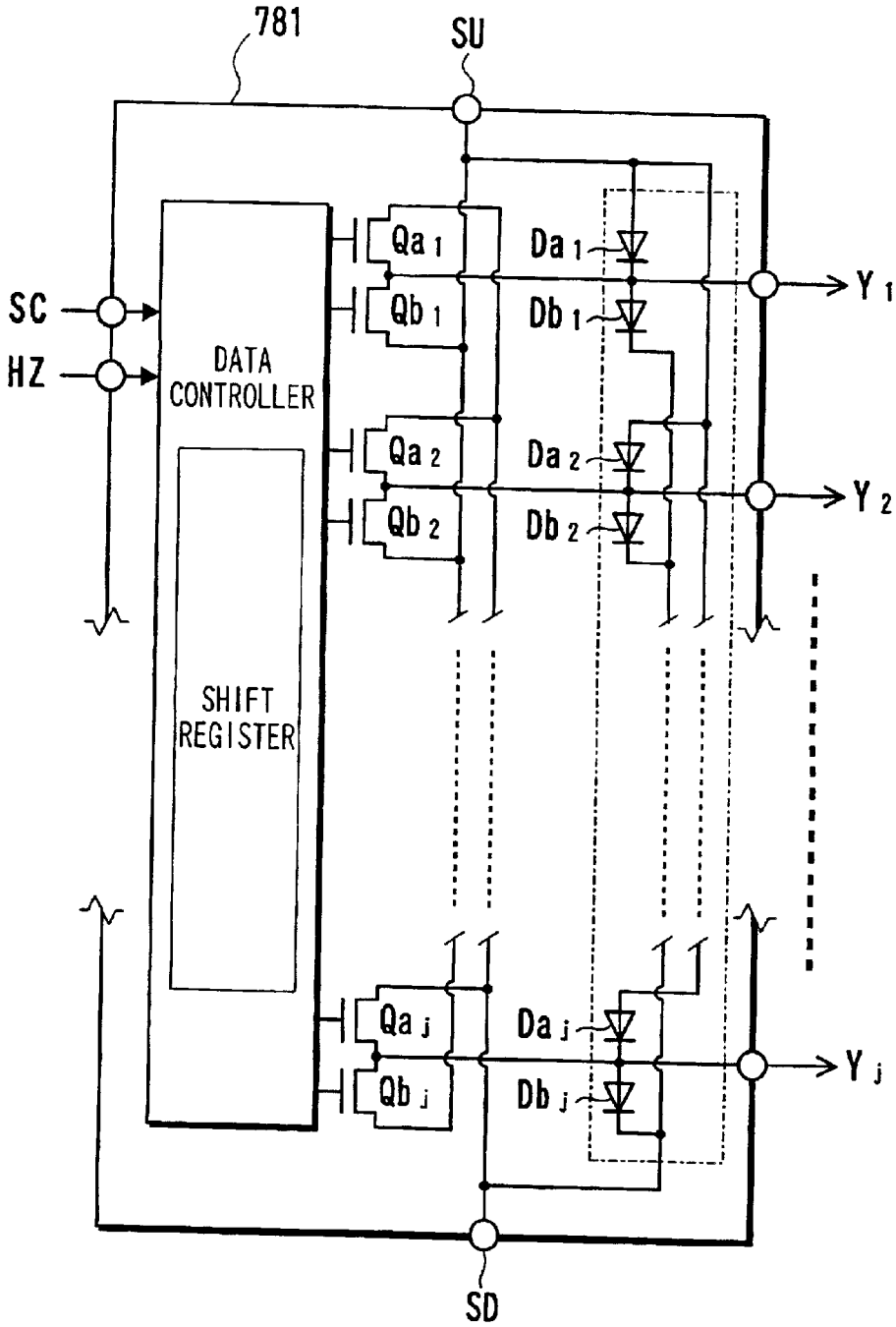
FIG. 4 is a diagram of a switch circuit that is called a scan driver.

FIG. 3 is a diagram of the scan circuit. FIG. 4 is a diagram of a switch circuit that is called a scan driver.

The scan circuit 780 includes plural scan drivers 781 for individual binary control of potential levels of n display electrodes Y and two switches (more specifically, switching devices such as FETs) Q50 and Q60 for switching voltage to be applied to the scan drivers. Each of the scan drivers 781 is an integrated circuit device and works for controlling j display electrodes Y. In a typical scan driver 781 that is actually used, j is approximately 60–120.

As shown in FIG. 4, in each of the scan drivers 781, each of the j display electrodes Y is provided with a pair of switches Qa and Qb. The j switches Qa have a common connection to a power source terminal SD, while j switches Qb have a common connection to a power source terminal SU. When the switch Qa is turned on, the display electrode Y is biased to the potential of the power source terminal SD at that moment. When the switch Qb is turned on, the display electrode Y is biased to the potential of the power source terminal SU at that moment. The control circuit 71 supplies a scan control signal SC to the switches Qa and Qb via a shift register in the data controller, so that a predetermined order of row selection is realized by shift operation in synchronization with a clock. In addition, the data controller performs a floating control, in which both the switches Qa and Qb are turned off simultaneously in accordance with a high impedance control signal HZ. On this occasion, current paths are broken, and an output of the display electrode Y becomes the high impedance state. The scan driver 781 also includes diodes Da and Db for making a current path when a sustaining pulse is applied.

As shown in FIG. 3, the power source terminals SU of all the scan drivers 781 have a common connection to the switch Q50, while the power source terminals SD of all the scan drivers 781 have a common connection to the switch Q60. The switches Q50 and Q60 are provided for using the scan driver 781 also for applying the sustaining pulse. In the address period, when the switch Q50 is turned on, the power source terminal SU is biased to selection potential Vya1. When the switch Q60 is turned on, the power source terminal SD is biased to non-selection potential Vya2. In the sustaining period, the switches Q50 and Q60 are turned off. All the switches Qa and Qb in the scan driver are also turned off by the high impedance control signal HZ. Therefore, the potential levels of the power source terminals SU and SD depend on the operation of the sustain circuit 790. The sustain circuit 790 includes a switch for switching the potential of the display electrode Y to the sustaining potential Vs or the ground potential and a power recovery circuit for charging and discharging capacitance of interelectrode XY between display electrodes at high speed utilizing an LC resonance.

Figure 5:
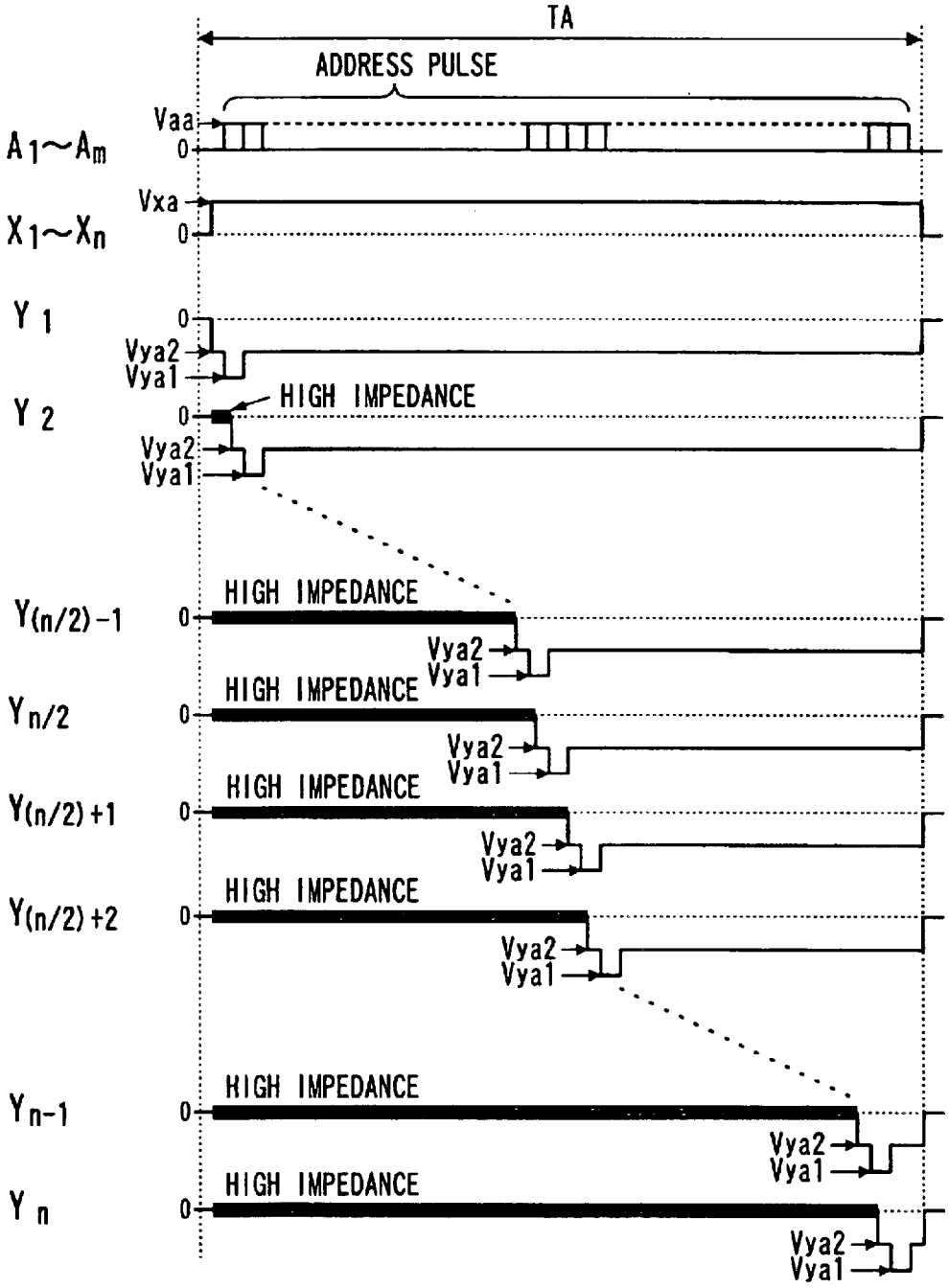
FIG. 5 shows a first example of driving voltage waveforms in the address period.

FIG. 5 shows a first example of driving voltage waveforms in the address period.

In this example, the row selection order of the addressing is the same as the arrangement order. The second and later display electrodes $Y_2$–$Y_n$ are kept in the high impedance state until just before the row selection timing comes, so that current path from the display electrode Y to the cell is broken. The display electrodes $Y_1$–$Y_n$ are biased to the non-selection potential Vya2 a bit before row selection and are biased to the selection potential Vya1 during the row selection. After the row selection, the display electrodes $Y_1$–$Y_n$ are biased to the non-selection potential Vya2 again.

Figure 6:
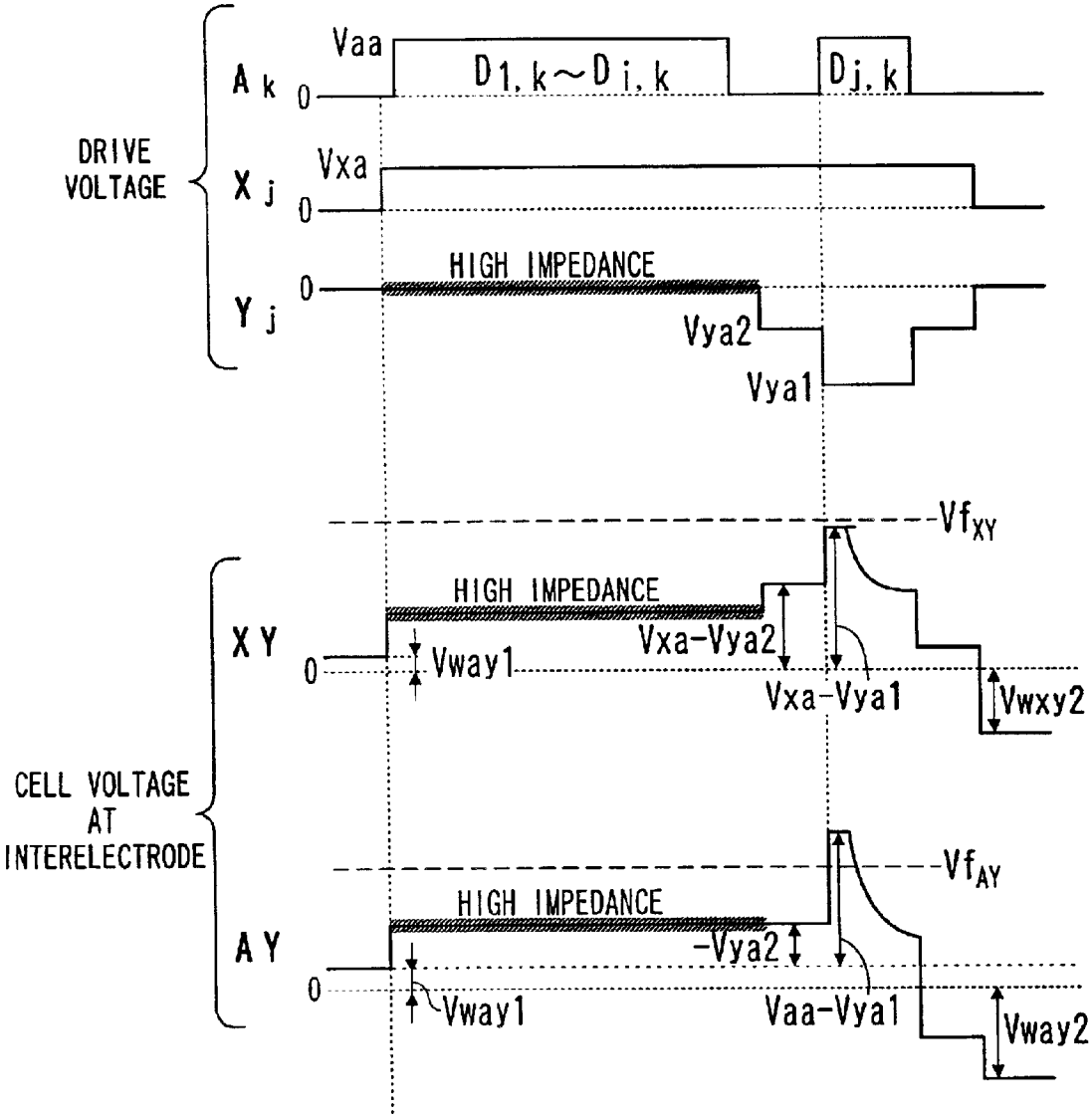
FIG. 6 shows a cell voltage change in the address period.
Figure 20:
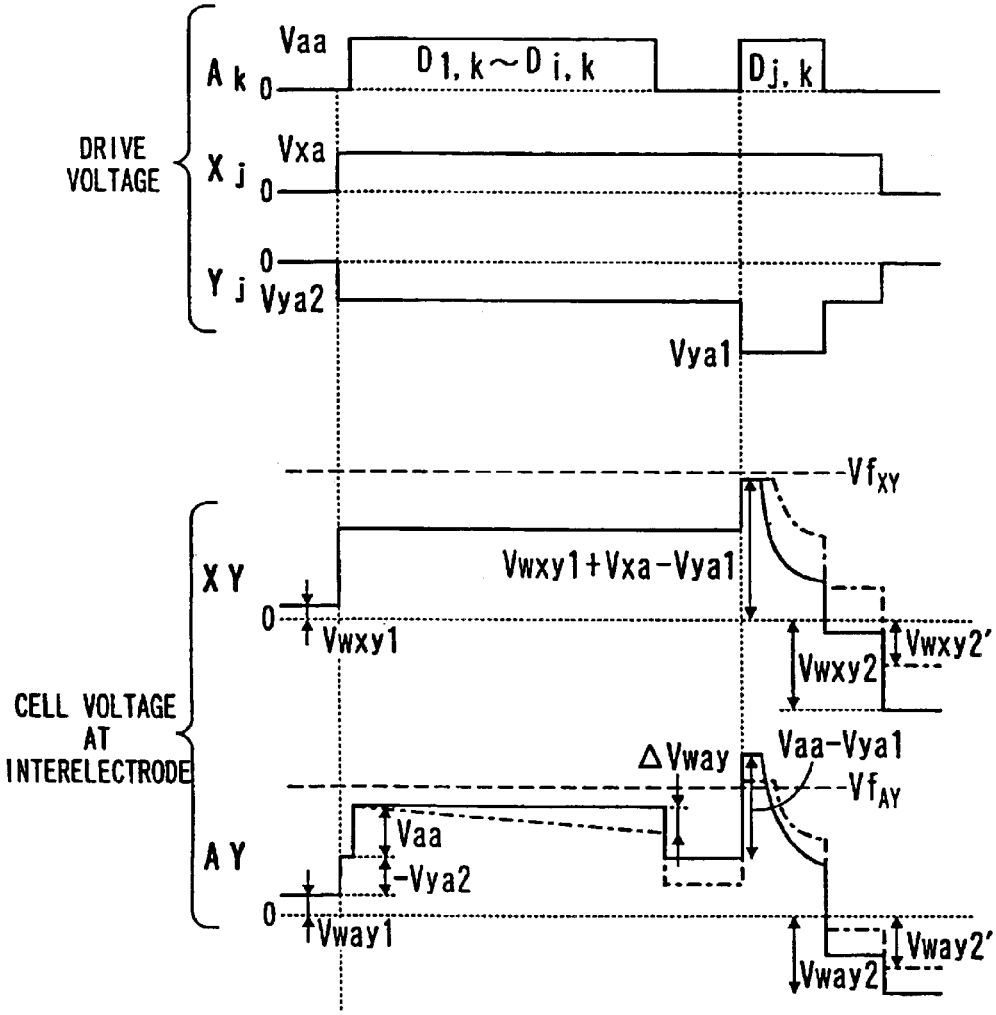
Fig. 20 (PRIOR ART)
FIG. 20 shows conventional waveforms of the cell voltage change in the address period.

FIG. 6 shows a cell voltage change in the address period. It is supposed that a display pattern of FIG. 6 is the same as that of FIG. 20.

Before row selection, the current path via the display electrode Y is broken over substantially the entire period of a selection waiting period. Namely, since the display electrode Y is in the high impedance state, no charge is supplied to the cell, and the wall voltage (wall charge) hardly changes even at high temperature. Therefore, when the display electrodes $Y_1$–$Y_n$ are biased to the selection potential Vya1 at row selection timing, sufficient intensity of address discharge occurs at the interelectrode AY and the interelectrode XY, so that appropriate wall voltage Vwxy2 is generated at the interelectrode XY.

Figure 7:
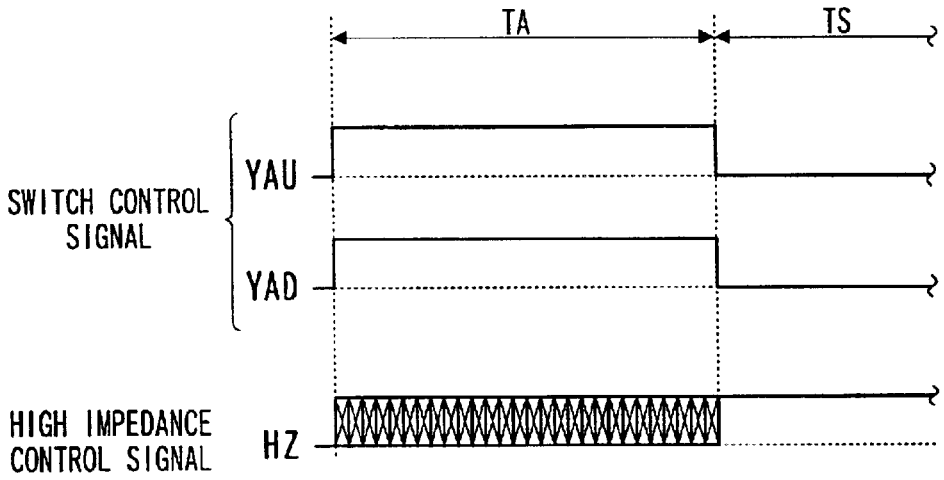
FIG. 7 is a timing chart indicating scan circuit control according to the first example of the driving voltage waveforms.

FIG. 7 is a timing chart indicating scan circuit control according to the first example of the driving voltage waveforms.

During address period TA, the sustain circuit 790 does not operate. The switch control signals YAU and YAD are turned on, so that the power source terminals SU and SD of the scan driver 781 are supplied with potential levels Vya1 and Vya2. In the address period TA, timing of the high impedance control signal HZ is set for each row so that an output state of the scan driver 781 is controlled. In the sustaining period TS, the switch control signals YAU and YAD are turned off, and the high impedance control signal HZ is turned on, so that the scan driver 781 cannot work.

Figure 8:
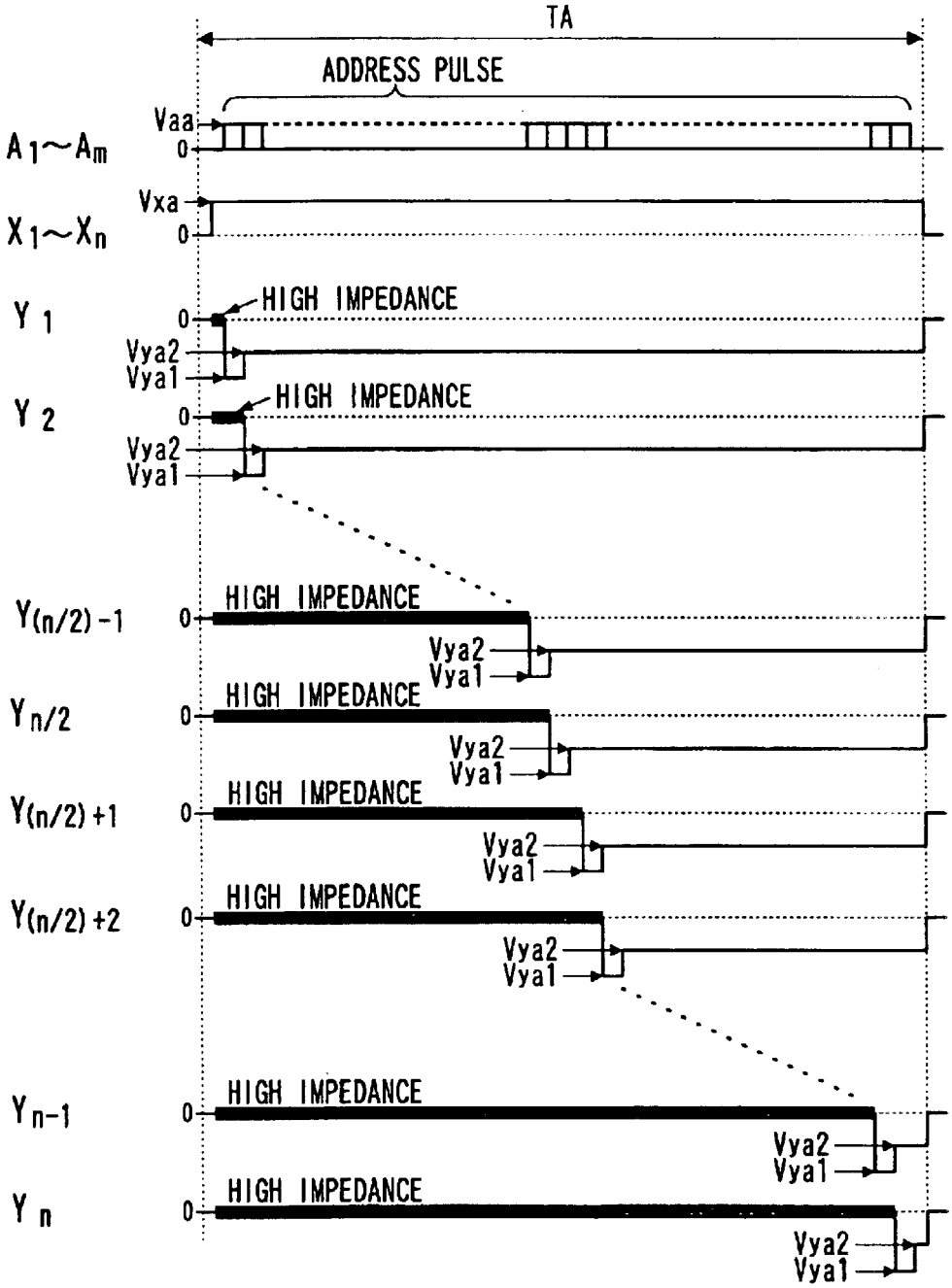
FIG. 8 shows a second example of the driving voltage waveforms in the address period.

FIG. 8 shows a second example of the driving voltage waveforms in the address period. In this example, the current path to the display electrode Y is broken until the row selection timing comes, so that the display electrode Y becomes floating, i.e., high impedance state. At the row selection timing, the display electrode Y is biased to the selection potential Vya1. When the row selection finishes, the display electrode Y is biased to the non-selection potential Vya2.

Figure 9:
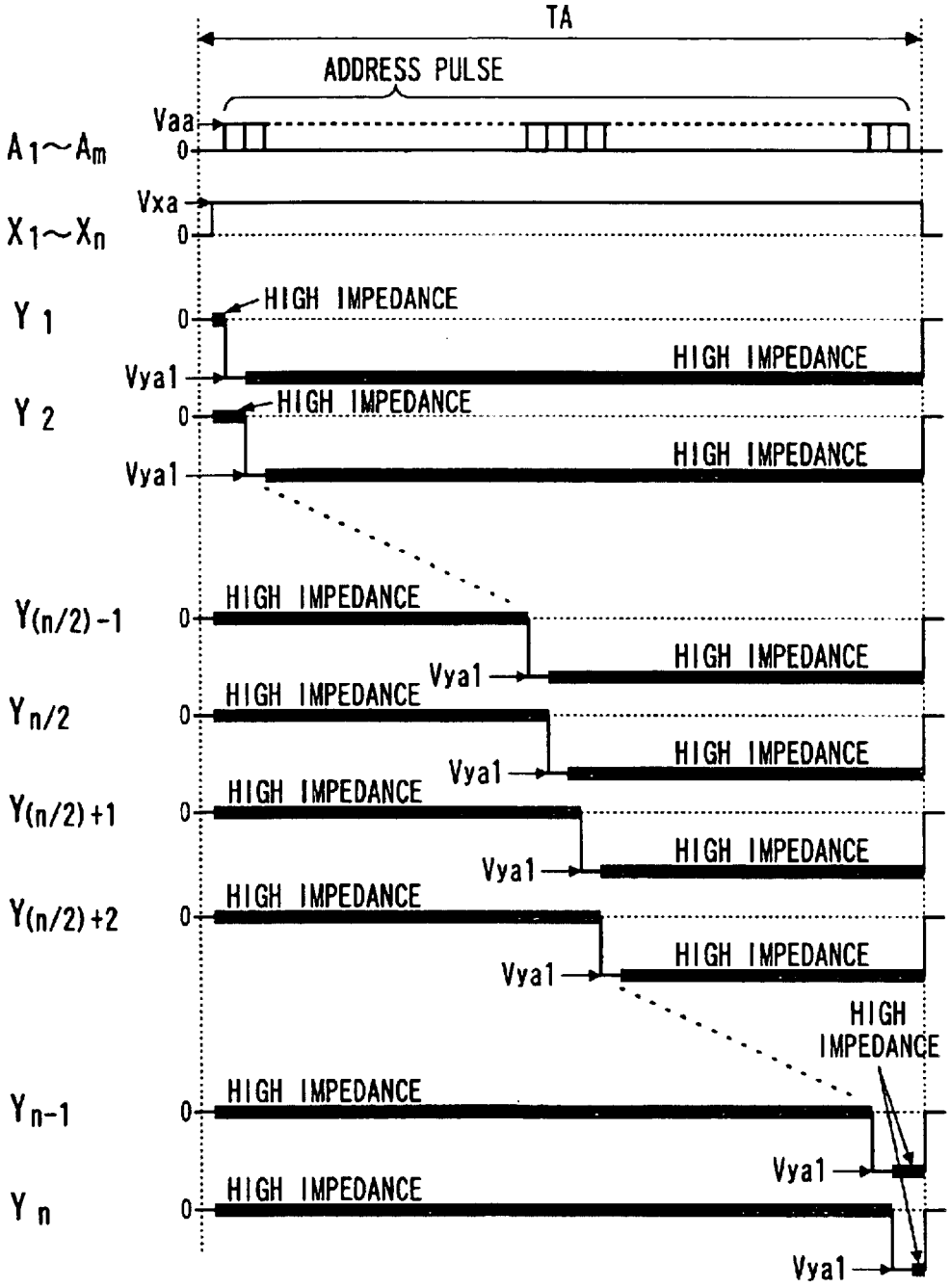
FIG. 9 shows a third example of the driving voltage waveforms in the address period.

FIG. 9 shows a third example of the driving voltage waveforms in the address period. In this example, the current path relating to the display electrode Y is made in high impedance state until the row selection timing comes. At the row selection timing, the display electrode Y is biased to the selection potential Vya1. After that, the current path to the display electrode Y of the row whose selection is finished is broken again so that the output becomes high impedance state.

Figure 10:
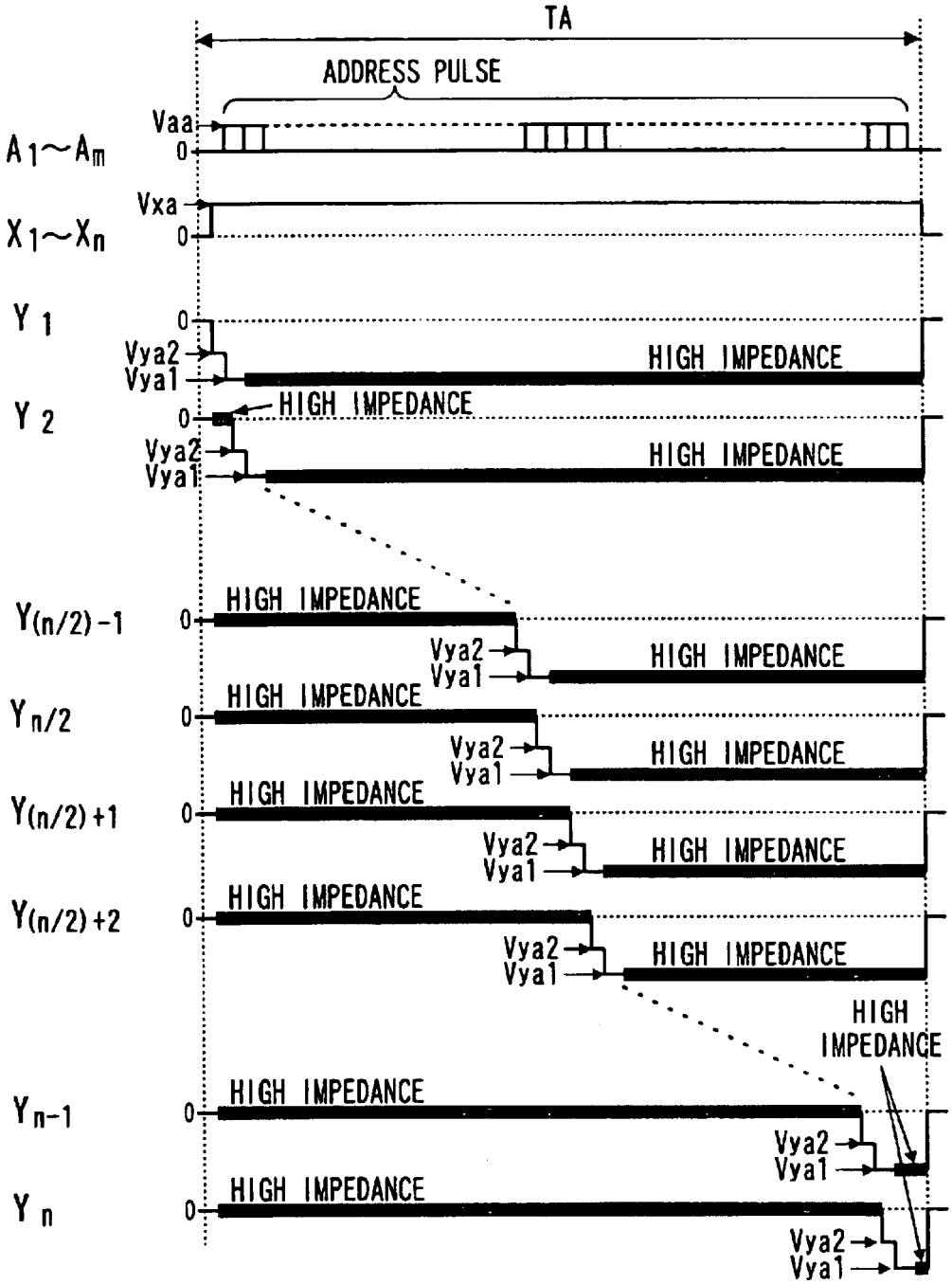
FIG. 10 shows a fourth example of the driving voltage waveforms in the address period.

FIG. 10 shows a fourth example of the driving voltage waveforms in the address period. In this example, the output is kept in high impedance state by breaking the current path until the row selection timing comes, and the display electrode Y is biased to the non-selection potential Vya2 just before the row selection. At the row selection timing, the display electrode Y is biased to the selection potential Vya1 and set to the high impedance state again after the row selection.

Figure 11:
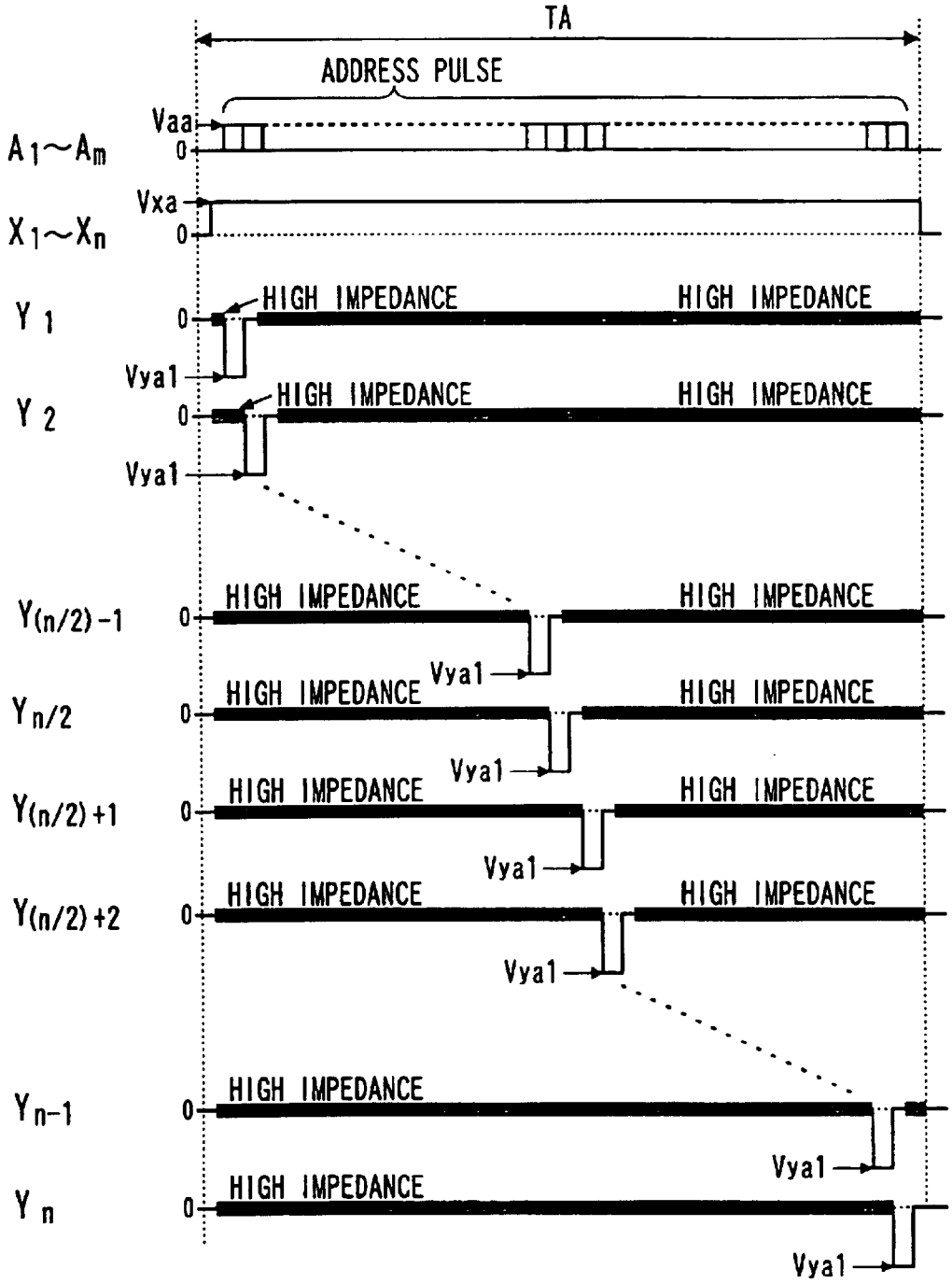
FIG. 11 shows a fifth example of the driving voltage waveforms in the address period.

FIG. 11 shows a fifth example of the driving voltage waveforms in the address period. In this example, the current path is kept in high impedance state until the row selection timing comes. At the row selection timing, the display electrode Y is biased to the selection potential Vya1. After that, the display electrode Y is returned to the ground potential, so that the current path becomes high impedance state.

Figure 12:
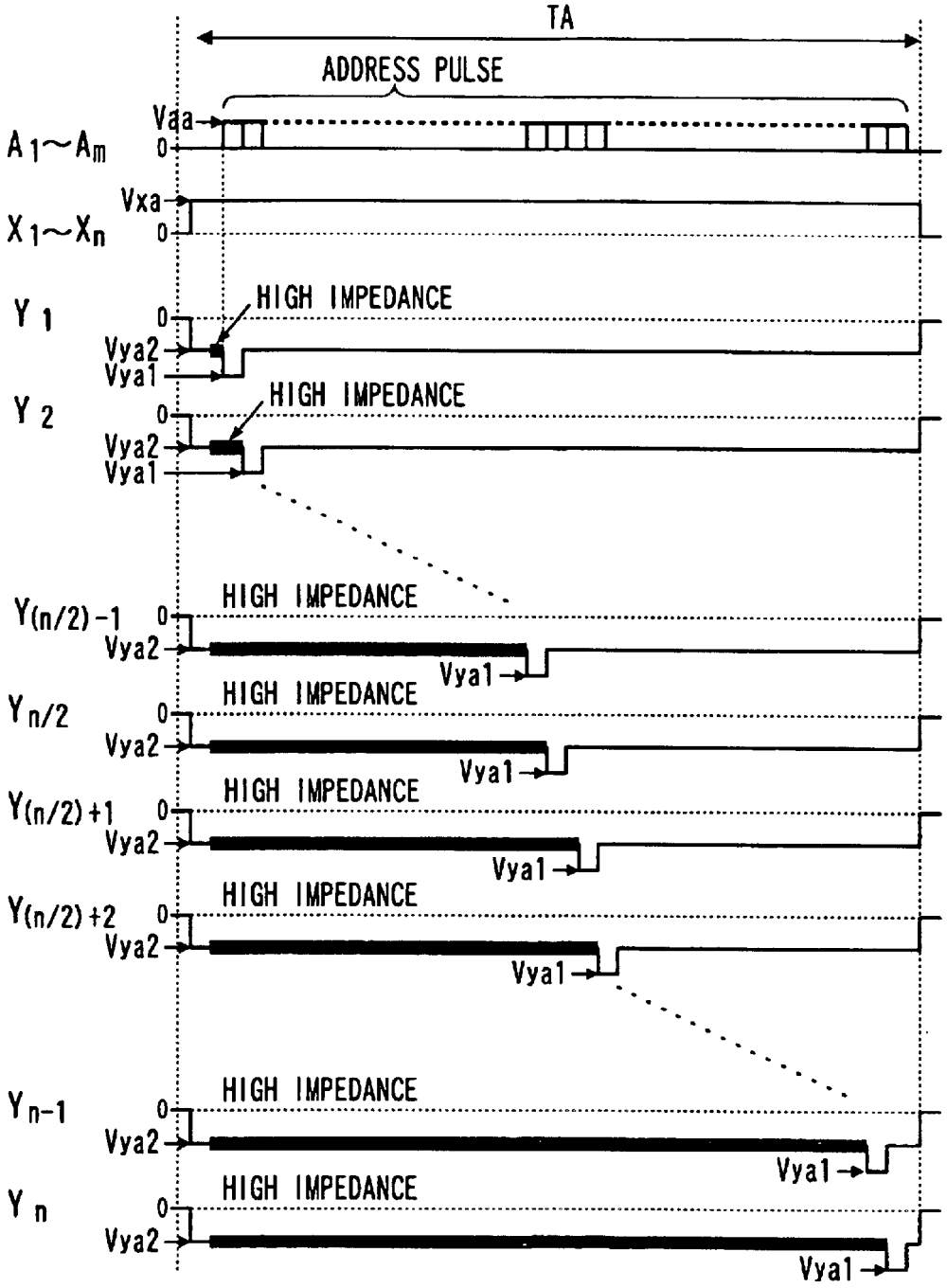
FIG. 12 shows a sixth example of the driving voltage waveforms in the address period.

FIG. 12 shows a sixth example of the driving voltage waveforms in the address period. When the potential of the display electrode Y is close to the ground potential, if the current path is broken to be floating, the voltage across the terminals can exceed the withstand voltage of the specification of the scan driver 781. Then, the scan driver 781 may break down. In this case, this example is useful. The display electrode Y is once fixed to the non-selection potential Vya2 and is made floating at the state to be high impedance state.

Figure 13:
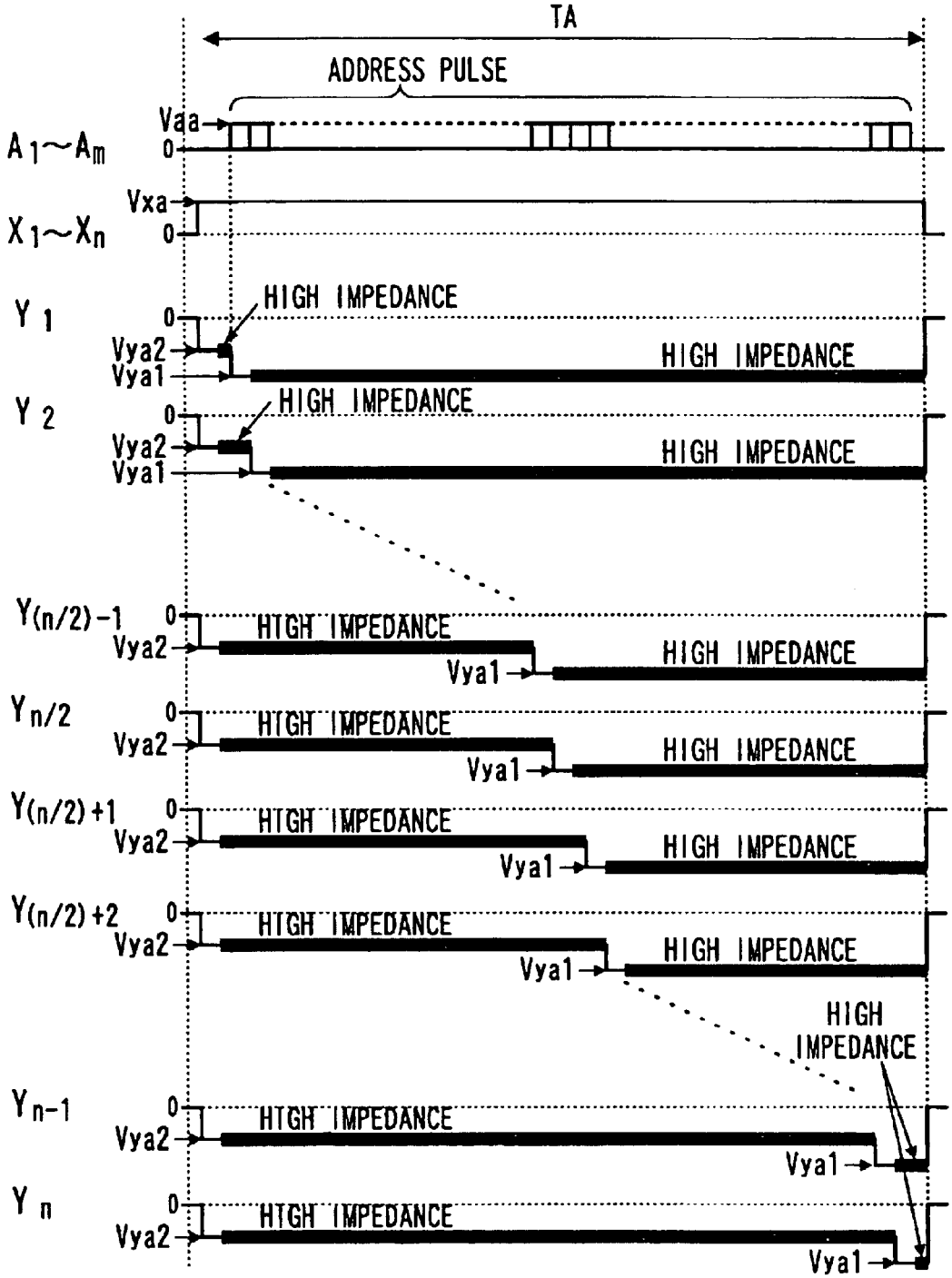
FIG. 13 shows a seventh example of the driving voltage waveforms in the address period.

FIG. 13 shows a seventh example of the driving voltage waveforms in the address period. In this example, the display electrode Y is once fixed to the non-selection potential Vya2, and then the current path is broken to maintain the high impedance state in the same way as the sixth example. At the row selection timing, the display electrode Y is biased to the selection potential Vya1, and the current paths of the rows whose selection are finished are broken again in sequential order to be the high impedance state.

Figure 14:
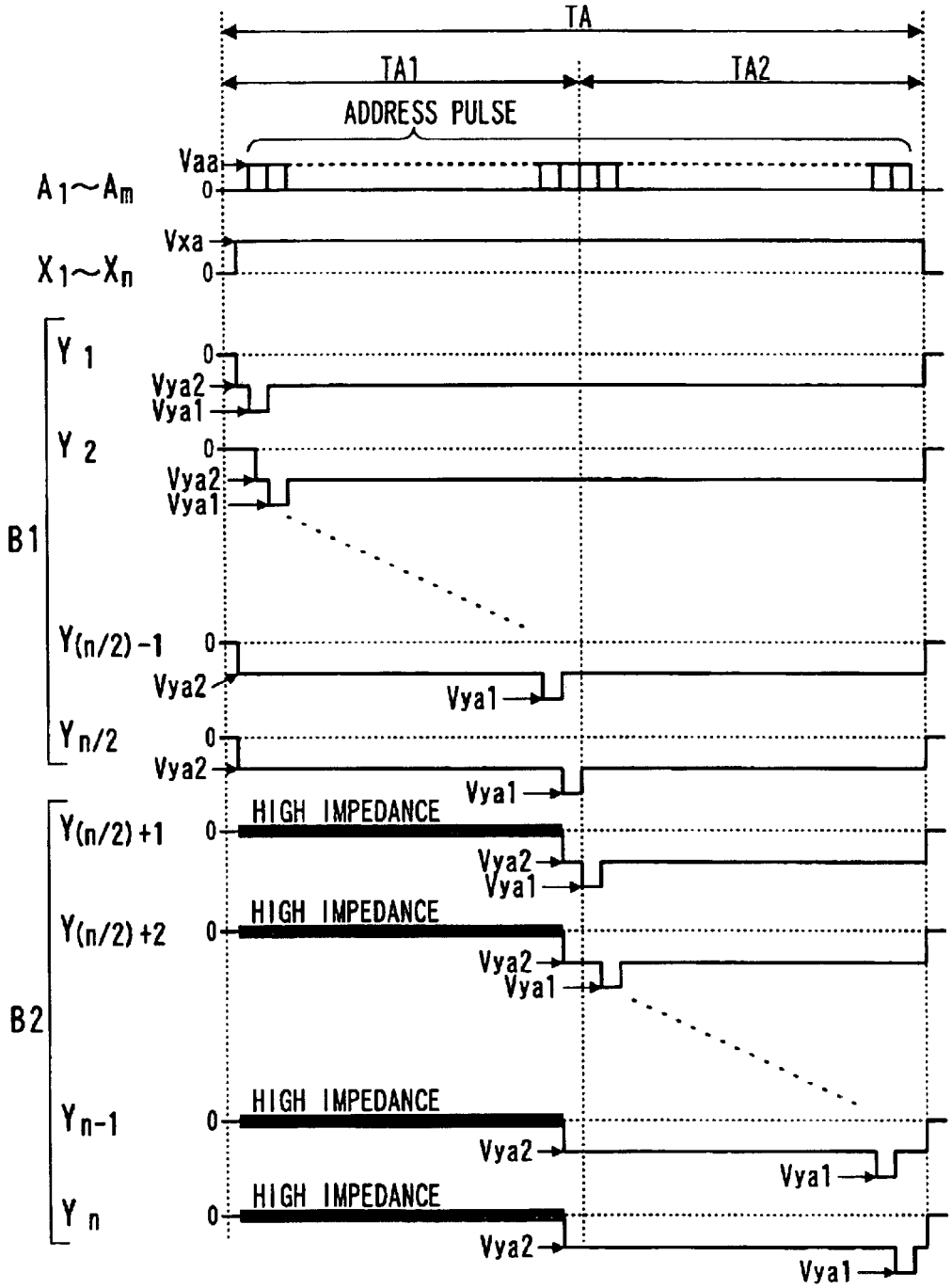
FIG. 14 shows an eighth example of the driving voltage waveforms in the address period.

In the above-explained examples, the current path of each row is broken to keep the output in the high impedance state. However, it is possible to bundle plural lines so as to control them block by block. FIG. 14 shows an eighth example of the driving voltage waveforms in the address period. Though the lines are divided into two blocks B1 and B2 in the following explanation, they can be divided into three or more blocks. For example, the block can be made for each scan driver 781. In FIG. 14, only the first block B1 is the target of the row selection in the first half TA1 of the address period TA, while the current path to the display electrode Y of the second block B2 is broken so that the output is made in the high impedance state. Concerning the second block B2, the row selection is performed in the second half TA2.

Figure 15:
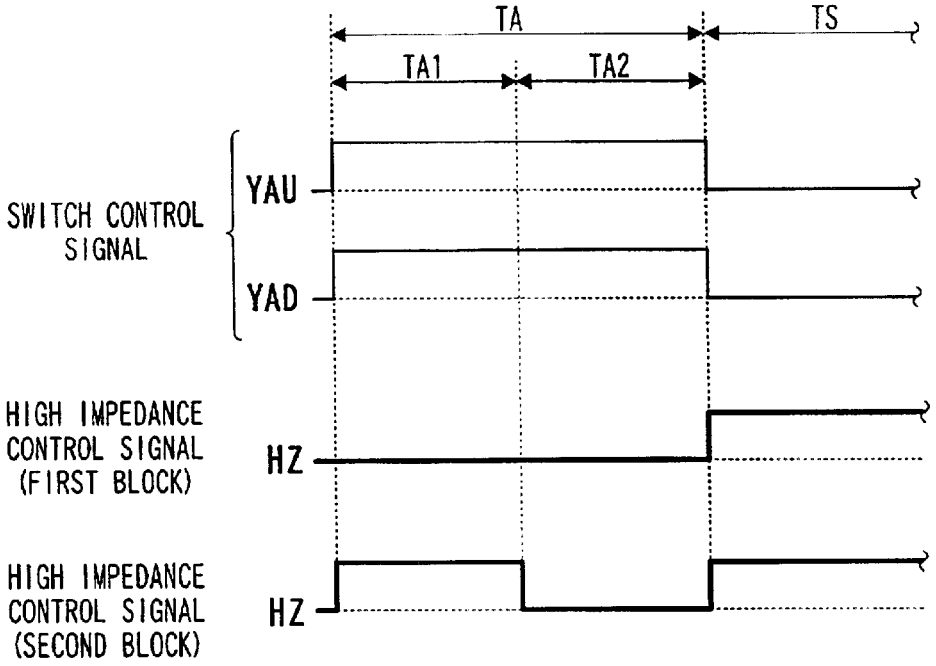
FIG. 15 is a timing chart showing the scan circuit control according to the eighth example of the driving voltage waveforms.

FIG. 15 is a timing chart showing the scan circuit control according to the eighth example of the driving voltage waveforms. Over the entire period of the address period TA, the high impedance control signal HZ is turned off for the first block B1. In the first half TA1, the high impedance control signal HZ is turned on for the second block B2.

Figure 16:
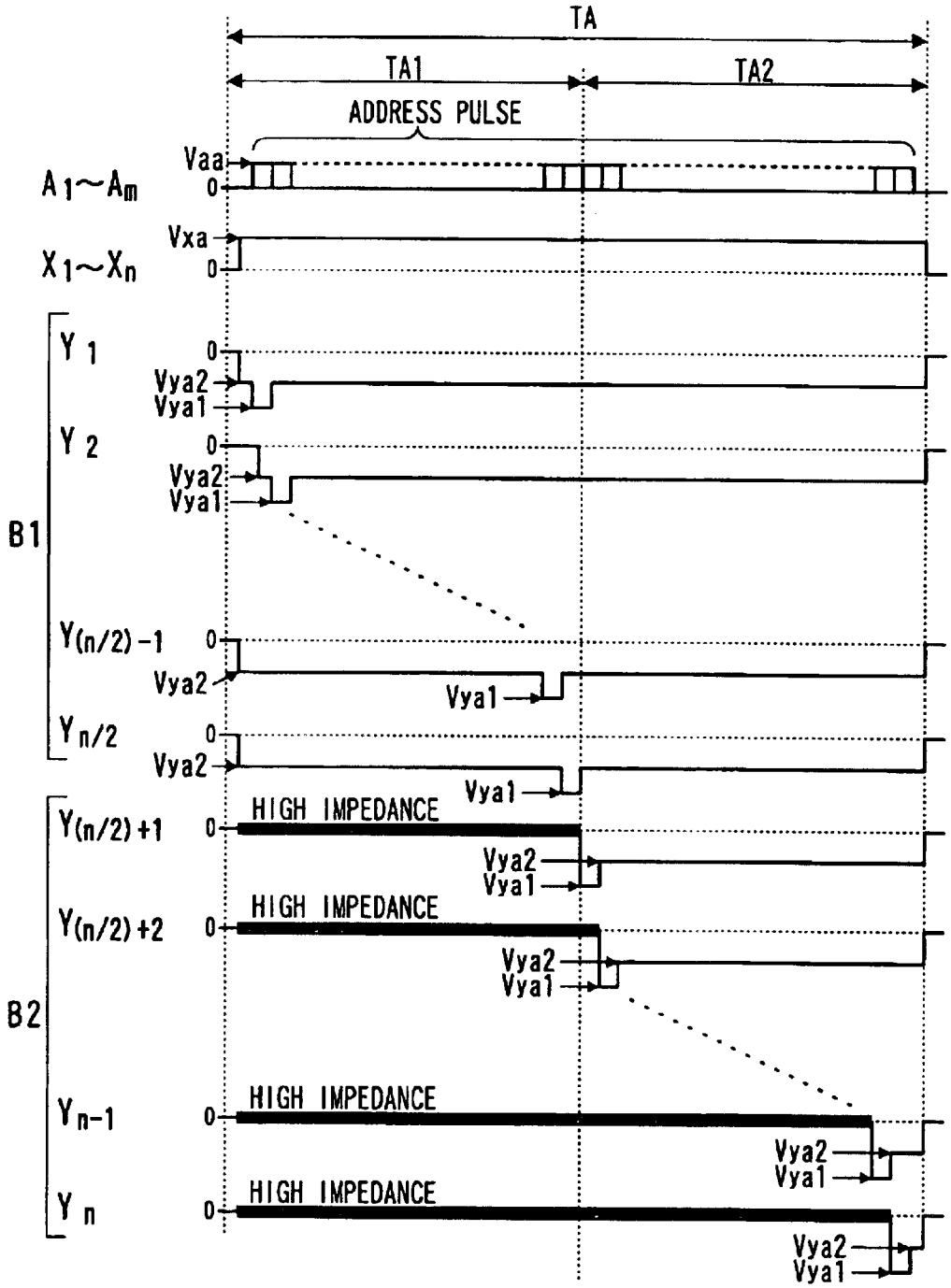
FIG. 16 shows a ninth example of the driving voltage waveforms in the address period.
Figure 17:
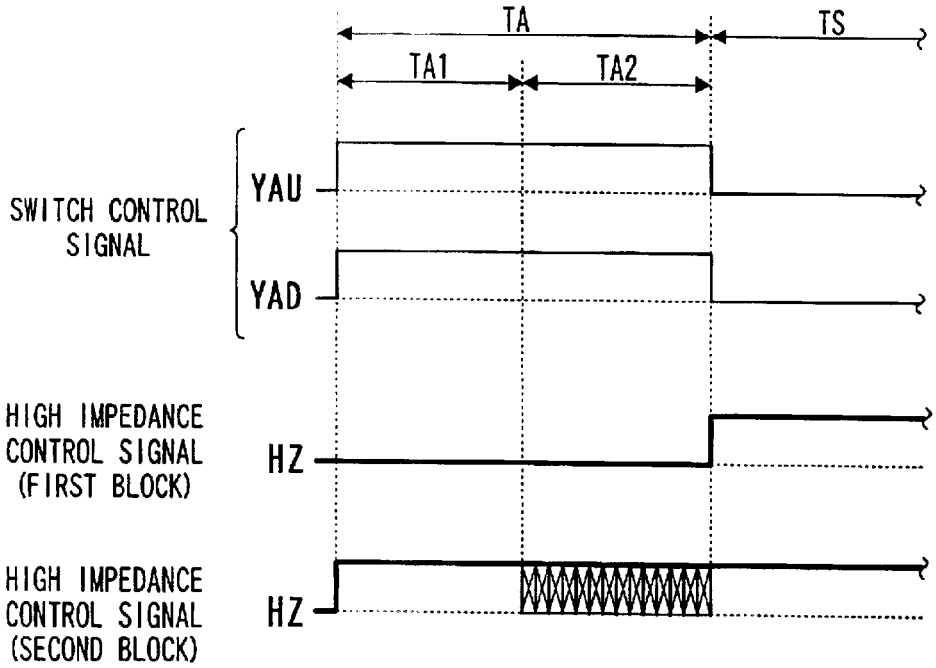
FIG. 17 is a timing chart showing the scan circuit control according to the ninth example of the driving voltage waveforms.

FIG. 16 shows a ninth example of the driving voltage waveforms in the address period. FIG. 17 is a timing chart showing the scan circuit control according to the ninth example of the driving voltage waveforms.

Only for the second block B2 for which the row selection is performed in the second half TA2, the current path concerning the display electrode Y is broken so that the output becomes the high impedance state over the selection waiting period before the row selection including the first half TA1.

In the above-explained examples, the prime purpose is to suppress the wall voltage change between the address electrode A and the display electrode Y at high temperature. However, wall voltage can change also between the address electrode A and the display electrode X, or between the display electrode X and the display electrode Y. Therefore, keeping the current path relating to the display electrode X in high impedance state in a part or the entire of the address period TA is also included within the scope of the present invention.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method of driving an AC type Plasma Display Panel (PDP) including a display screen on which display electrodes, forming electrode pairs for surface discharge for respective rows or a matrix display, and address electrodes crossing the display electrodes are arranged, the method comprising:

using one of the display electrodes of each electrode pair as a scan electrode of a respective row;

in an address period biasing the scan electrode of each said row to a non-selection potential level that is closer to a selection potential level than a ground potential level;

after the biasing, keeping at least one scan electrode in a high impedance state to a power source line over at least a part of a selection waiting period before the at least one scan electrode is biased to the selection potential level in the address period for addressing; and generating discharge for addressing by biasing an address electrode of a selected column to an address potential level in synchronization with row selection of biasing the scan electrode of a selected row to the selection potential level.

2. The method according to claim 1, wherein in the address period for addressing, at least one scan electrode is placed in the high impedance state to the power source line before and after the at least one scan electrode is biased to the selection potential level.

3. The method according to claim 1, wherein the keeping the at least one scan electrode in the high impedance state is performed for the respective scan electrode of each row.

4. The method according to claim 1, wherein the keeping the at least one scan electrode in the high impedance state is performed for the respective scan electrodes of each block of plural rows in a row selection order.

5. The method according to claim 1, wherein the keeping the at least one scan electrode in the high impedance state is performed for the respective scan electrodes of each block of plural rows in a row selection order, a number of rows corresponding to a driving electrode number of one integrated circuit used for the row selection.

6. The method according to claim 1, wherein in the address period, each of the scan electrodes is biased to the non-selection potential level before and after biasing each of the scan electrodes to the selection potential level.

7. The method according to claim 1, wherein the ground potential level is between the address potential level and the non-selection potential level.

8. A device for driving an AC type Plasma Display Panel (PDP) comprising:

a display screen on which display electrodes, forming electrode pairs for surface discharge for respective rows of a matrix display, and address electrodes crossing the display electrodes are arranged;

one of the display electrodes of each electrode pair being used as a scan electrode of a respective row;

in an address period, the scan electrode of each said row being biased to a non-selection potential level that is closer to a selection potential level than a ground potential level, and after that, at least one scan electrode being placed in a high impedance state to a power source line over at least a part of a selection waiting period before the at least one scan electrode is biased to the selection potential level in the address period for addressing; and the address electrode of a selected column being biased to an address potential level in synchronization with row selection of biasing the scan electrode of a selected row to the selection potential level, so that discharge for addressing is generated.

9. A display device, comprising: an AC type Plasma Display Panel (PDP) including a display screen on which display electrodes, forming electrode pairs for surface discharge for respective rows of a matrix display, and address electrodes crossing the display electrodes are arranged; and a driver to drive the AC type PDP, wherein in an address period for addressing, one of the display electrodes of each electrode pair is used as a scan electrode of a respective row, the scan electrode of each said row is biased to a non-selection potential level that is closer to a selection potential level than a ground potential level, and after that, at least one scan electrode is placed in a high impedance state to a power source line over at least a part of a selection waiting period before the at least one scan electrode is biased to the selection potential level, and the address electrode of a selected column is biased to an address potential level in synchronization with row selection of biasing the scan electrode of a selected row to the selection potential level, so that discharge for addressing is generated.

10. A method of driving an AC type Plasma Display Panel (PDP) including a display screen on which display electrodes, forming electrode pails for surface discharge far respective rows of a matrix display, and address electrodes crossing the display electrodes are arranged, the method comprising:

using one of the display electrodes of each electrode pair as a scan electrode of a respective row;

In an address period, biasing the scan electrode of each said row to a non-selection potential level that is closer to a selection potential level than a ground potential level and placing the scan electrode of each said row in a high impedance state to substantially isolate a power source line from a display cell of the matrix display over at least a part of a selection waiting period, and further biasing the scan electrode to the selection potential level for addressing; and generating discharge for addressing by biasing the address electrode of a selected column to an address potential level in synchronization with row selection of biasing the scan electrode of a selected row to the selection potential level.

* * * * *

UNITED STATES PATENT AND TRADEMARK OFFICE

CERTIFICATE OF CORRECTION

PATENT NO. : 6,833,823 B2
DATED : December 21, 2004
INVENTOR(S) : Koichi Sakita

It is certified that error appears in the above-identified patent and that said Letters Patent is hereby corrected as shown below:

Column 10,
Line 39, change "pails" to -- pairs -- and change "far" to -- for --
Line 45, change "In" to -- in --

Signed and Sealed this

Thirty-first Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,833,823 B2
APPLICATION NO. : 09/949086
DATED : December 21, 2004
INVENTOR(S) : Koichi Sakita It is certified that error appears in the above-identified patent and that said Letters Patent is hereby corrected as shown below:

Column 9, line 11 change “or” to for --

Signed and Sealed this

Fifth Day of September, 2006

JON W. DUDAS
*Director of the United States Patent and Trademark Office*